United States Patent [19]

Howell et al.

[11] 4,037,377

[45] July 26, 1977

[54] FOAMED-IN-PLACE DOUBLE-SKIN BUILDING PANEL

[75] Inventors: Norbert C. Howell, Connersville; Walter Tischuk, Richmond; Thomas M. Welsh, Connersville, all of Ind.

[73] Assignee: H. H. Robertson Company, Pittsburgh, Pa.

[21] Appl. No.: 86,425

[22] Filed: Nov. 3, 1970

Related U.S. Application Data

[63] Continuation-in-part of Ser. No. 732,689, May 28, 1968, abandoned.

[51] Int. Cl.[2] ..... E04C 1/10; E04C 2/20

[52] U.S. Cl. ..... 52/309.9; 52/592; 52/595

[58] Field of Search ..... 52/615, 309, 592, 593, 52/588, 479, 404, 594, 595, 619, 539, 536, 538, 542, 519, 520, 483, 478, 546

[56] References Cited

U.S. PATENT DOCUMENTS

| | | | |
|---|---|---|---|
| 2,912,725 | 11/1959 | Ries | 52/404 |
| 3,353,318 | 11/1967 | Bacher | 52/593 |
| 3,367,076 | 2/1968 | O'Brien | 52/309 |
| 3,535,844 | 10/1970 | Glaros | 52/309 |

FOREIGN PATENT DOCUMENTS

| | | | |
|---|---|---|---|
| 1,523,418 | 3/1968 | France | 52/593 |

*Primary Examiner*—John E. Murtagh
*Attorney, Agent, or Firm*—Harry B. Keck; George E. Manias

[57] ABSTRACT

A double-skin construction panel having its outer skin spaced-apart from its inner skin. The panels are adapted to be assembled without exposed fasteners. A positive mechanical connection between the outer skin and the foamed-in-place panel core is provided. The panels have mating elements in the outer skin to provide for positive mechanical engagement of adjacent outer sheets when the panels are assembled in use.

33 Claims, 35 Drawing Figures

INVENTORS
NORBERT C. HOWELL
WALTER TISCHUK
THOMAS M. WELSH

BY George E. Manias
AGENT

INVENTORS
NORBERT C. HOWELL
WALTER TISCHUK
THOMAS M. WELSH

BY George E. Manion
AGENT

INVENTORS
NORBERT C. HOWELL
WALTER TISCHUK
THOMAS M. WELSH

BY George E. Maniar
AGENT

INVENTORS
NORBERT C. HOWELL
WALTER TISCHUK
THOMAS M. WELSH

BY George E. Manias
AGENT

FOAMED-IN-PLACE DOUBLE-SKIN BUILDING PANEL

CROSS-REFERENCES TO RELATED APPLICATIONS (IF ANY)

This application is a continuation-in-part of copending application Ser. No. 732,689, filed May 28, 1968 now abandoned, and assigned to the assignee of the present invention.

BACKGROUND OF THE INVENTION

1. Field of the Invention:

The invention relates to double skin building construction panels having a foamed-in-place core.

2. Description of the Prior Art:

Double skin construction panels are well known in the prior art for use in the construction of building, U.S. Pat. No. 2,284,229. Such double skin panels have utilized thermal-insulation materials such as glass fiber batts, lightweight foamed plastic blocks and the like to maintain the outer sheet in spaced-apart relation. When building panels with spaced-apart facing sheets are applied to a building framework, some means is provided to secure the inner sheet to the framework such as rivets, self-tapping screws, welding, et cetera. The retention of the outer sheet is not always reliable. By providing metal fasteners extending entirely through the outer sheet, the core and the inner sheet, a through-conduction path for thermal transfer results which minimizes the effectiveness of the thermal-insulating properties of the core material. Some double-skin construction panels, e.g., U.S. Pats. Nos. 2,730,210; 3,276,626, provide for the mating of the outer sheet and the inner sheet at the side edges of the panel; this feature provides an objectionable through-conduction path for thermal transfer. Some panels utilize different materials, e.g., relatively low thermal conductivity materials such as polyvinyl chloride, wood, rubber, to serve as side rails for the panels to maintain the inner and outer facing sheets in a relatively rigid, spaced-apart relationship which avoids the high thermal conductivity of metal but does not achieve the exceptionally low thermal conductivity which is desirable, U.S. Pat. No. 3,113,401. In many building panels the outer sheet is maintained in its intended relation by an adhesive film, U.S. Pat. No. 3,235,040. In other panels the outer sheet is auto-adhered to the foamed-in-place panel core. In both of these instances, subsequent weather exposure tends to deteriorate the adhesive bond and thereby to jeopardize the structural integrity of the panel.

SUMMARY OF THE INVENTION

The principal object of this invention is to provide a foamed-in-place double-skin building panel wherein a positive mechanical connection is provided between the outer facing sheet and the foamed-in-place core, whereby the outer facing sheet does not depend solely for its structural integrity upon the auto-adhesive bond between the foamed-in-place core and the outer facing sheet.

Another object of this invention is to provide foamed-in-place double-skin building panels which when assembled in operative relationship in a building wall, provide a positive mechanical engagement between the outer facing sheets of adjacent building panels.

A further object of this invention is to provide foamed-in-place double skin building panels which when assembled in operative relationship in a building wall, provide positive mechanical engagement between the outer facing sheets of adjacent building panels and between the inner facing sheets of the same adjacent building panels.

Still another object of this invention is to provide a foamed-in-place double skin building panel wherein the outer facing sheet and the inner facing sheet are physically separated by the foamed-in-place core whereby no through-conduction path for thermal transfer is present.

The building construction panel has an outer facing sheet, an inner facing sheet and a plastic foam core which is formed by foamed-in-place techniques preferably from polurethane. The facing sheets preferably are fabricated from sheet metal, e.g., aluminum alloys; galvanized steel; painted steel; aluminized steel; protected metal sheets. Other materials having structural integrity may be employed as facing sheets, e.g., reinforced plastic sheets. Each of the facing sheets has a central web and side walls which are essentially parallel to each other and extend from the web of the sheet in the same direction.

The facing sheets are spaced-apart by the foamed-in-place plastic core which substantially entirely fills the void space between the outer facing sheet and the inner facing sheet. The webs of the two sheets are essentially parallel. The two sheets are laterally offset from one another so that the side walls of the outer facing sheets are laterally spaced-apart from the side walls of the inner facing sheet, with a gap therebetween.

One side wall of the facing sheet is provided with a lengthwise bead; the other side wall of the facing sheet is provided with a complementary groove. When the panels are in use, the bead of one side wall is engaged with the complementary groove of the side wall of an abutting panel. If desired, the beads and grooves may also be provide in the side walls of the inner facing sheet. The function of the beads and grooves is to provide a positive mechanical engagement between the facing sheet of one panel and the facing sheet of an abutting panel when the panels are assembled in operative relationship in a building wall.

In one embodiment, the side walls of each facing sheet are provided with a first or re-entrant flange and a second or outward flange. The flanges of each sheet are essentially parallel to each other and extend away in the same direction from the adjoining side walls, whereby the re-entrant flange overlies the web and the outward flange extends laterally away from the web. When the inner and outer facing sheets are assembled in laterally offset relation, the outward flange of each sheet confronts the web of the other sheet and is spaced-apart from the re-entrant flange of the other sheet.

In an alternative embodiment, one side wall of each facing sheet terminates in a free edge while the other side wall is provided with an outward flange. The outward flange extends laterally away from the web and is essentially parallel therewith. When the inner and outer facing sheets are assembled in laterally offset relation, the outward flange of each sheet confronts the web of the other sheet and is spaced-apart from the free edge of the side wall of the other facing sheet.

In a further alternative embodiment, both side walls of each facing sheet terminate in free edges. When the inner and outer facing sheets are assembled in laterally offset relation, the free edge of one side wall of each facing sheet confronts the web of the other facing sheet and is spaced-apart from the free edge of the other facing sheet side wall.

DESCRIPTION OF THE PREFERRED EMBODIMENTS(S)

Figure 1:
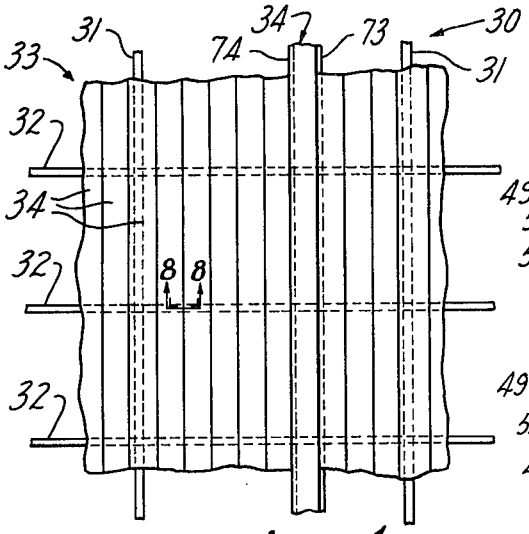
FIG. 1 is a fragmentary front view of a building wall incorporating the foamed-in-place double-skin building panels of this invention.

FIG. 1 illustrates a building structural framework 30 comprising vertical columns 31 and vertically spaced horizontal girts 32. The building structural framework 30 supports a wall structure 33 comprising a plurality of building panels 34 of this invention. As will be more fully described, each of the building panels 34 has a longitudinal edge 73 secured to the horizontal girts 32 and an opposite longitudinal edge 74 disposed in positive mechanical engagement with the adjacent building panel.

In general, the present building panel is of the type comprising an outer facing sheet, an inner facing sheet and a foamed-in-place core which connects the facing sheets and maintains them in spaced-apart relation.

FIGS. 2 through 6 illustrate facing sheets 35 to 39, respectively. Certain combinations (a pair) of the facing sheets 35 to 39 are used in producing the building panel of this invention. Certain elements are common to all of the facing sheets 35 to 39 and corresponding numerals will be employed to identify those common elements.

Referring to FIGS. 2 to 6, the facing sheets 35 to 39, include a central web 40 having first and second longitudinal side edges 41, 42. First and second side walls 43, 44 are provided along the first and second side edges 41, 42, respectively of the facing sheets 35, 36 and 38. First and second inclined side walls 43', 44' are provided along the first and second side edges of the facing sheets 37 and 39. The first and second side walls 43, 44 and 43', 44' extend in the same direction relative to the central web 40 and are generally parallel. A first flange 45, re-entrant from the first side wall 43 (43'), extends generally parallel with the central web 40 and terminates at an edge 45*a* which is spaced from the first side wall 43 (43'). A second flange 46 extends outwardly from the second side wall 44 (44') and is generally parallel to the central web 40.

Figure 2:
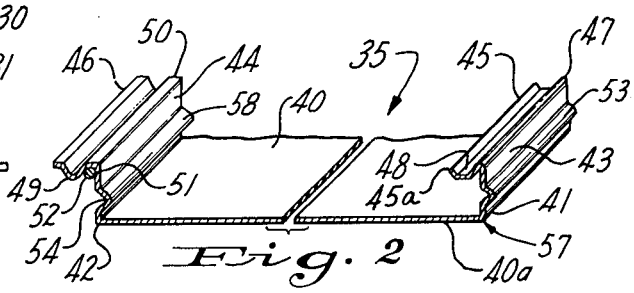
FIGS. 2 through 6 are fragmentary isometric views of facing sheets useful in the production of the present building panel.
Figure 3:
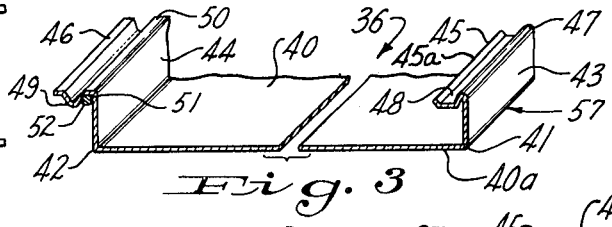
Figure 4:
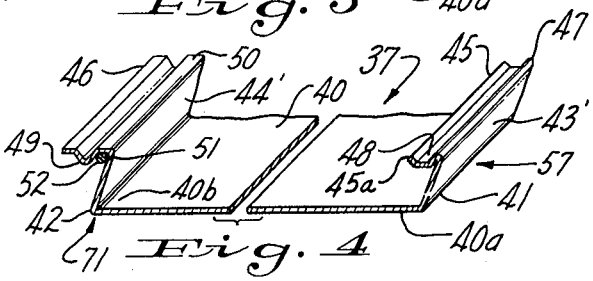

Referring now in particular to FIGS. 2, 3 and 4, a lip 47 is provided at the juncture of the first side wall 43 and the first flange 45. The first flange 45 is provided with a lengthwise trough 48 which opens outwardly away from the central web 40. The second flange 46 is provided with a lengthwise rib 49 which is positioned to be received in the lengthwise trough 48 of an abutting facing sheet. The second flange 46 provides a shoulder 50 which is disposed between the rib 49 and the second side wall 44. The shoulder 50 presents a shoulder recess 51. A sealant material 52 is deposited along substantially the entire length of the shoulder recess 51. The arrangement is such that when two of the facing sheets 35, 35 or 36, 36 or 37, 37 are installed in side-by-side relation, the lip 47 of one of the facing sheets will penetrate the sealant material 52 of the abuting facing sheet to provide positive alignment and an esentially weather tight seal.

Referring now in particular to FIG. 2, the first side wall 43 of the facing sheet 35 is provided with a lengthwise bead 53 projecting outwardly from the first side wall 43 away from the central web 40. The second side wall 44 is provided with a complementary lengthwise groove 54 positioned to receive a bead 53 of an abutting facing sheet 35. The bead 53 and the complementary groove 54 comprise complementary mating elements arranged to provide a positive mechanical connection between adjacent ones of the facing sheet 35.

Figure 6:
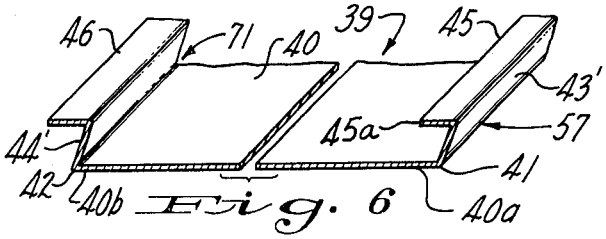

Referring to FIGS. 4 and 6, it will be seen that the first and second side walls 43', 44' of the facing sheets 37, 39 are obliquely inclined relative to the central web 40 and are generally parallel to each other. As will be more fully described later in the specification, the first and second inclined side walls 43', 44' comprise complementary mating elements arranged to provide a positive mechanical connection between abutting ones of the facing sheets 37 or abutting ones of the facing sheets 39.

The facing sheets 35 to 39 (FIGS. 2 to 6) each present a channel-like configuration 57 defined by the first flange 48, the first side wall 43 (43') and an adjoining portion 40*a* of the central web 40. The facing sheet 35 (FIG. 2) has an arcuate side wall portion 58 which defines the complementary groove 54 and which projects laterally of the second side wall 44 over the central web 40. The facing sheets 37, 39 (FIGS. 4 and 6) present an angle-shaped configuration 71 defined by the inclined second side wall 44' and an adjoining portion 40*b* of the central web 40. As will hereinafter be more fully described, the channel-like configuration 57, the arcuate side wall portion 58 and the angle-shaped configuration 71, each provide a positive mechanical connection between the facing sheets and a foamed-in-place core 55 (FIG. 7).

Figure 5:
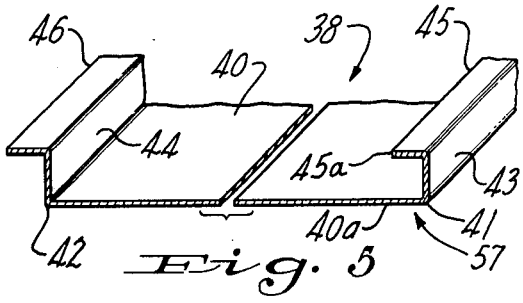

The facing sheets 35 to 39 can be arranged in various combinations to produce the building panel of this invention. For the purposes of this invention, those facing sheets whose side walls include complementary mating elements are used as outer facing sheets. Accordingly, the facing sheets 35, 37 and 39 of FIGS. 2, 4 and 6 are used as outer facing sheets and may have an essentially flat or profiled central web 40. The facing sheets 35, 37 and 39 also may be used as inner facing sheets. For the purposes of this invention, the facing sheets 36 and 38 of FIGS. 3 and 5 are useful only as inner facing sheets.

Figure 7:
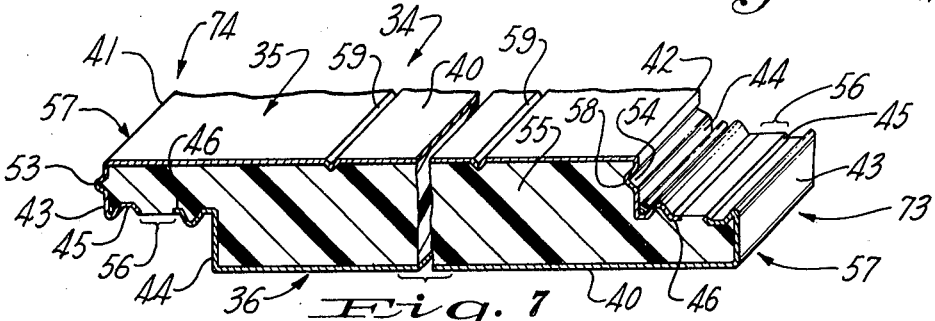
FIG. 7 is a fragmentary isometric view of a bulding panel of this invention utilizing the facing sheets of FIGS. 2 and 3.

One embodiment of the building panel 34 of this invention is illustrated in FIG. 7. The building panel 34 comprises an outer facing sheet 35, an inner facing sheet 36 and a foamed-in-place plastic core 55 disposed between the outer facing sheet 35 and the inner facing sheet 36. The facing sheets 35, 36 are laterally offset from one another. The overall arrangement is such that the second flange 46 of each facing sheet 36, 35 is laterally spaced-apart from the first flange 45 of the other facing sheet 35, 36 and confronts the opposing central web 40. A gap 56 is provided between each adjacent pair of the first and second flanges 45, 46 along each longitudinal edges 73, 74 of the building panel 34, whereby the outer facing sheet 35 is entirely spaced-apart from the inner facing sheet 36. Accordingly, the panel 34 presents no through-conduction path for thermal transfer.

The channel-shaped configuration 57 of the outer facing sheet 35 provides a positive mechanical connection between the foamed-in-place core 55 and the outer facing sheet 35. The arcuate side wall portion 58 in the second side wall 44 of the outer facing sheet 35, also provides a positive mechanical connection between the foamed-in-place core 55 and the outer facing sheet 35. As a result of this construction, the outer facing sheet 35 does not depend solely for its structural integrity upon the auto-adhesive bond between the foamed-in-place core and the outer facing sheet. Similarly, the channel-shaped configuration 57 of the inner facing sheet 36 provides a positive mechanical connection between the foamed-in-place core 55 and the inner facing sheet 36.

If desired, a plurality of longitudinal grooves 59 may be provided in the central web 40 of the outer facing sheet 35 for rigidizing the web 40 and for aesthetic appearance of the product. The longitudinal grooves 59 present an exterior appearance which corresponds with the exterior appearance of the juncture between the first and second side edges 41, 42 of the outer facing sheets 35 of adjacent building panels 34. See FIG. 8.

Figure 8:
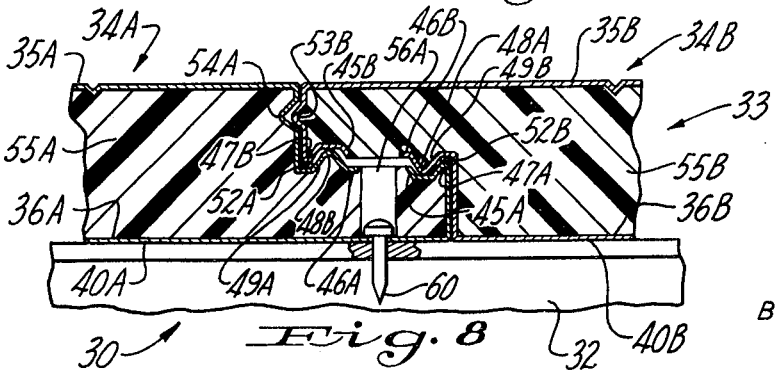
FIG. 8 is a cross-sectional view, taken along the lie 8—8 illustrating a connection between adjacent ones of the building panel of FIG. 7.

FIG. 8 illustrates a pair of the building panels 34A, 34B assembled in operative relation to form the wall structure 33. The building panel 34A is secured to the structural framework 30 bu suitable fasteners 60 (only one shown). The fastener 60 is installed in the region of the gap 56A and passes through the central web 40A of the inner facing sheet 36A into the horizontal girt 32. The rib 49B and trough 48B of the building panel 34B engage the corresponding trough 48A and rib 49A, respectively, of the building panel 34A. The outer facing sheets 35A, 35B are entirely spaced-apart from the inner facing sheets 36A, 36B. The lips 47A, 47B of the building panels 34A, 34B penetrate the sealant materials 52B, 52A, respectively, to provide two essentially weather tight seals. The bead 53B in the outer facing sheet 35B of the building panel 34B is engaged with the complementary groove 54A in the outer facing sheet 35A of the building panel 34A, whereby the outer facing sheets 35A, 35B are positively and mechanically engaged with one another. The complementary mating elements (bead 53B and complementary groove 54A) provide the sole positive mechanical connection between the outer facing sheets 35A and 35B.

FIGS. 9–18, inclusive, alternative embodiments of the present building panel. Corresponding numerals will be employed to identify corresponding parts heretofore described.

All of the building panels, when installed in operative relation in a building wall, provide a positive mechanical connection between adjacent outer facing sheets. It is possible for the building panels to provide, in addition, a positive mechanical connection between the inner facing sheets of abutting building panels.

Figure 9:
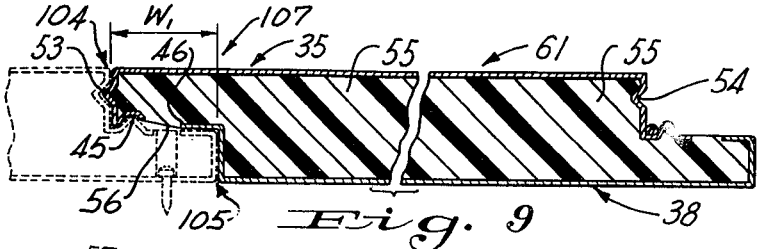
FIGS. 9 through 18 are fragmentary cross-sectional views illustrating alternative embodiments of the present building panel formed by combination of the building sheets of FIGS. 2 through 6.

The building panel 61 of FIG. 9, comprises an outer facing sheet 35, an inner facing sheet 38 and a foamed-in-place core 55.

Figure 10:
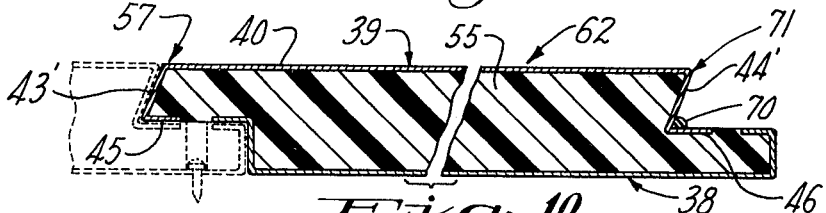

The building panel 62 of FIG. 10, comprises an outer facing sheet 39, an inner facing sheet 38 and a foamed-in-place core 55. The inclined first and second side walls 43',44' of the outer facing sheet 39 develop positive mechanical engagement with the second and first inclined side walls of adjacent building panels. If desired, a field applied sealant material 70 may be provided along the juncture of the inclined second side wall 44' and the second flange 46 of the outer facing sheet 39. It should also be noted that the channel-shaped configuration 57 provides a mechanical connection between the foamed-in-place core 55 and the outer facing sheet 39. Similarly, the angle-shaped configuration 71 provides a second positive mechanical connection between the foamed-in-place core 55 and the outer facing sheet 39.

Figure 11:
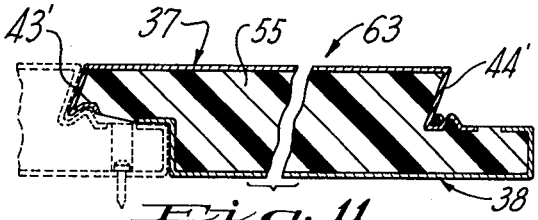
Figure 12:
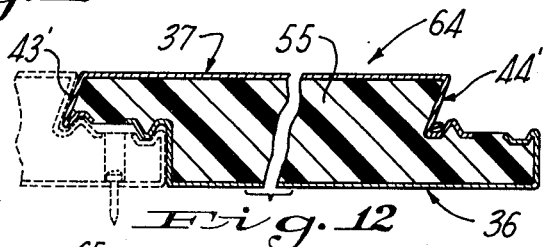

The building panels 63, 64 of FIGS. 11 and 12 respectively, are similar to the building panel 62 of FIG. 10.

Figure 13:
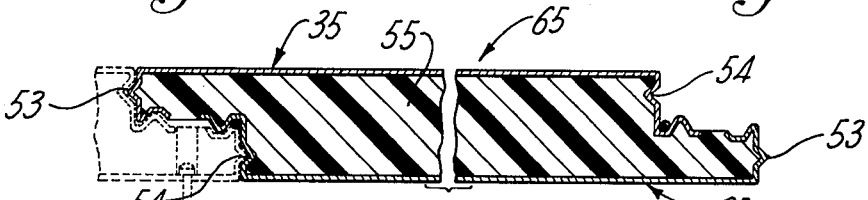
Figure 14:
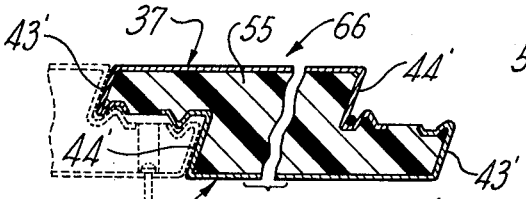
Figure 15:
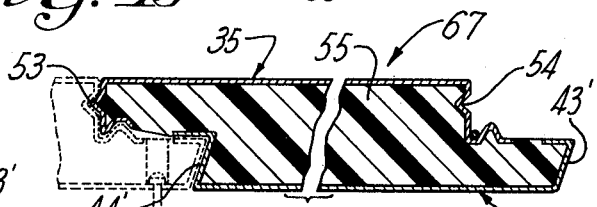
Figure 16:
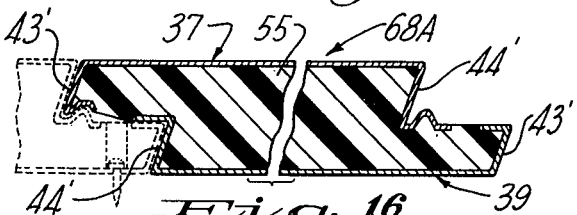

The building panel 65 of FIG. 13 utilized two of the facing sheets 35, one as the outer facing sheet and one as the inner facing sheet. The bead 53 and complementary groove 54 of the outer facing sheet 35 permit positive mechanical engagement to be made with the outer facing sheets of abutting building panels 65; and the bead 53 and the complementary groove 54 of the inner facing sheet 35 permit positive mechanical engagements between the inner facing sheets of abutting building panels 65.

The building panels 66, 67, 68A, 68B and 69 of FIGS. 14, 15, 16, 17 and 18 respectively, have outer facing sheets providing positive mechanical connections with the outer facing sheets of abutting building panels; and have inner facing sheets providing positive mechanical connections with the inner facing sheets of abutting building panels.

The building panel 66 (FIG. 14) utilizes a pair of the facing sheets 37. It is inmaterial which of the facing sheets 37 is presented as the outer facing sheet.

The building panel 67 (FIG. 15) may be reversed to present the facing sheet 39 as the outer facing sheet.

Figure 17:
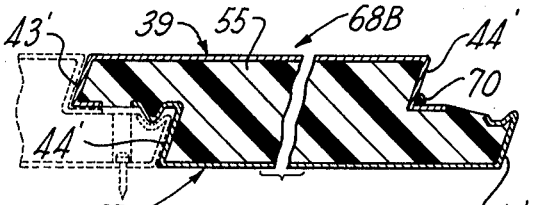
Figure 18:
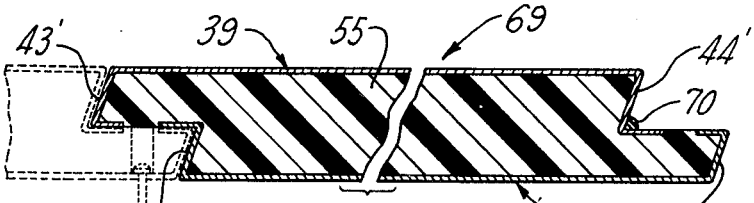

The building panels 68A (FIG. 16) and 68B (FIG. 17) are identical panels differing only in that the building panel 68A has been reversed in FIG. 17 to produce the building panel 68B.

The building panel 69 (FIG. 18) utilizes a pair of the facing sheets 39. Again, it is inmaterial which of the facing sheets 39 is presented as the outer facing sheet.

Figure 20:
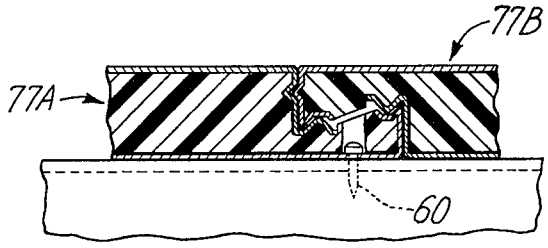
FIG. 20 is a fragmentary cross-sectional view illustrating an overlapped connection between a pair of the panel units of FIG. 19.
Figure 19:
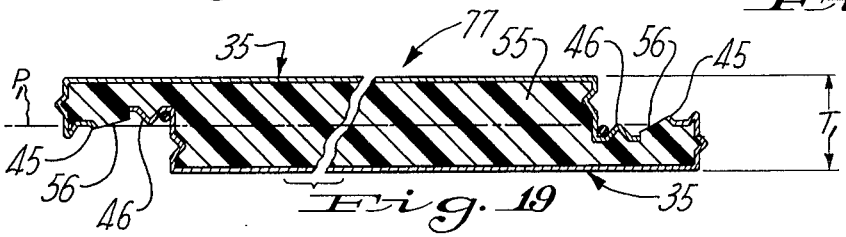
FIG. 19 is a cross-sectional view illustrating a further alternative embodiment of the present building panel.

A further alternative embodiment of the present building panel unit is illustrated in FIGS. 19 and 20. Corresponding numerals will be employed to identify corresponding parts heretofore described.

In FIG. 19 there is illustrated a building panel 77 comprising an outer facing sheet 35, an inner facing sheet 35 and a foamed-in-place core 55. In this embodiment, the first and second flanges 45, 46 of the inner facing sheet 35 are positioned between (a) the central web 40 of the outer facing sheet 35 and (b) a plane $P_1$ extending between the first and second flanges 45, 46 of the outer facing sheet 35. As a result of this arrangement, the building panel 77 has a thickness indicated at $T_1$ which is less than, for example, the corresponding thickness of the building panel 34 of FIG. 7. This arrangement has the advantage of utilizing a lesser quantity of core filling material.

FIG. 20 illustrates a typical connection between adjacent building panels 77A, 77B erected in side-by-side relation and secured to the horizontal girt 32 by suitable fasteners 60 (only one shown).

Figure 22:
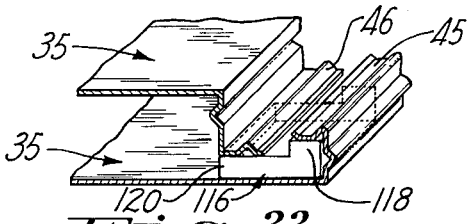
FIG. 22 is a fragmentary isometric view illustrating the spacer member of FIG. 21 installed between a pair of facing sheets.
Figure 21:
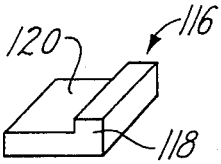
FIG. 21 is an isometric view of preformed spacer members.
Figure 23:
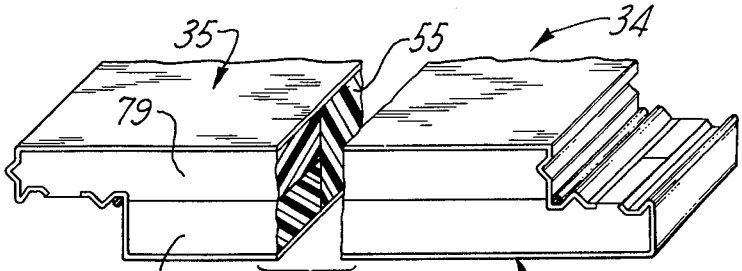
FIG. 23 is an isometric end view of the building panel of FIG. 7 illustrating the use of preformed end closures.

When manufacturing the building panel 77, it is desirable to support the second flange 46 of the outer facing sheet 35 in that position shown in FIG. 19, relative to the first flange 45 of the inner facing sheet 35. Such support is provided by a preformed spacer member 116, illustrated in FIG. 21. The spacer member 116 includes a thick segment 118 and a thin segment 120. The spacer member is installed, as shown in FIG. 22, by inserting the thick segment 118 beneath the first flange 45 of the inner facing sheet 35. When the outer facing sheet 35 is positioned over the inner facing sheet 35, its second flange 46 will be supported by the thin segment 120. The opposite end of the outer facing sheet 35 will be supported by mold apparatus described and illustrated in copending Ser. No. 71,493, filed Sept. 11, 1970 which was abandoned in favor of continuation-in-part application Ser. No. 127,615 filed Mar. 24, 1971, and now U.S. Pat. No. 3,759,279. The spacer members 116 are provided at spaced locations along the length of inner facing sheet 35 to provide the necessary support for the second flange of the outer facing sheet 35.

When manufacturing any of the present building panels, for example the building panel 34, the opposite ends of the facing sheets 35 and 36 are provided with preformed end closures 79. When the facing sheets 35, 36 are brought together in opposed relation, the preformed end closures 79 effectively seal the panel ends and assure that the foamed-in-place core 55 completely fills the void space between the end closures 79 and the facing sheets 35, 36.

Further alternative embodiments of the present building panel are illustrated in FIGS. 24 through 33. Corresponding numerals will be employed to identify corresponding parts heretofore described.

Figure 24:
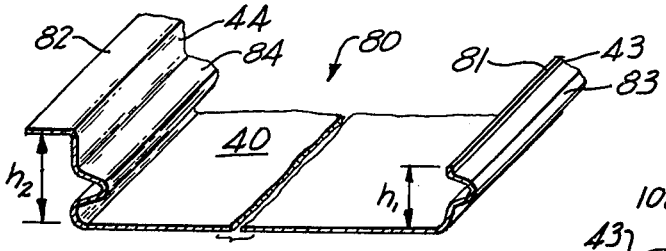
FIG. 24 is a fragmentary broken isometric view illustrating an alternative embodiment of a facing sheet.

FIG. 24 illustrates a facing sheet 80 wherein the first side wall 43 terminates in a first free edge 81. A second or outward flange 82 adjoins a second edge **44*a* of the second side wall 44 and extends laterally therefrom in a direction away from the central web 40. The flange 82 is essentially parallel with the central web 40. The first and second side walls 43, 44 are provided with complementary mating elements. In this embodiment, the complementary mating elements are in the form of a convex rib 83 (first side wall 43) and a complementary concave rib 84 (second side wall 44**).

Figure 25:
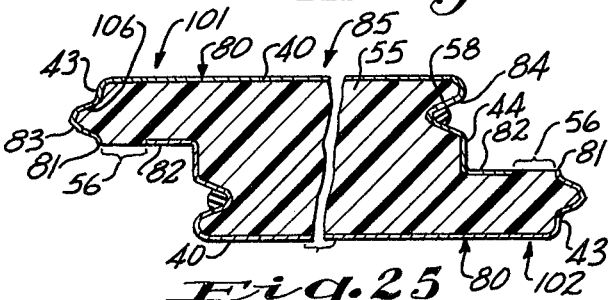
FIG. 25 is a broken cross-sectional view illustrating an alternative embodiment of the present building panel incorporating a pair of the facing sheets of FIG. 24.

A pair of the facing sheets 80 may be assembled in laterally offset relation and separated by a foamed-in-place core 55 to provide a building construction panel 85 (FIG. 25). It will be observed in FIG. 25, that the outward flange 82 of each facing sheet confronts the central web 40 of the other facing sheet and is laterally spaced-apart from the first side wall 43 of the other facing sheet, with the gap 56 therebetween.

Figure 26:
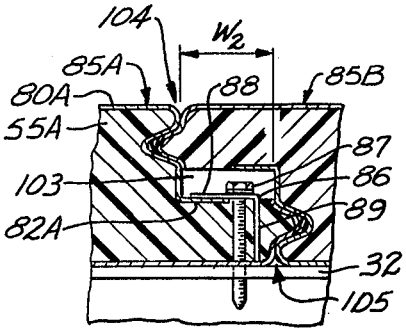
FIG. 26 is a fragmentary cross-sectional view, similar to FIG. 8, illustrating a connection between adjacent ones of the panel of FIG. 25.

FIG. 26 illustrates a joint between adjacent ones of the building panels 85A and 85B. The panel 85A is secured to the subgirt 32 by a clip 86 and fastener 87. The clip 86 has a first leg 88 overlying the outward flange 82A of the outer facing sheet 80A and a second leg 89 penetrating the foam core 55A.

Figure 27:
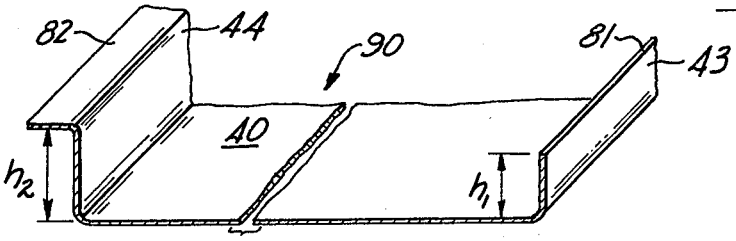
FIG. 27 is a fragmentary broken isometric view illustrating an alternative embodiment of an inner facing sheet.
Figure 28:
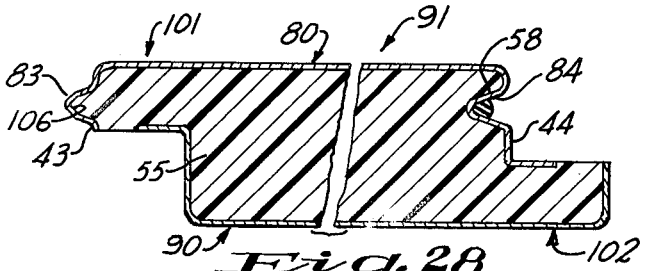
FIG. 28 is a broken cross-sectional view of an alternative embodiment of the present building panel incorporating the facing sheets of FIGS. 24 and 27.

FIG. 27 illustrates an inner facing sheet 90 wherein the first side wall 43 terminates in the free edge 81 and wherein the outward flange 82 adjoins the second edge **44*a* of the second side wall 44. The inner facing sheet 90 may be assembled in laterally offset relation with the other facing sheet 80 to produce a building panel 91 (FIG. 28). In the building panel 91, only the outer facing sheet 80 is provided with complementary mating elements in the form of the convex rib 83 and the complementary concave rib 84. Adjacent ones of the building panels 91 may be assembled in overlapped relation and secured to a subgirt in exactly the same manner described above in connection with FIG. 26.**

Figure 29:
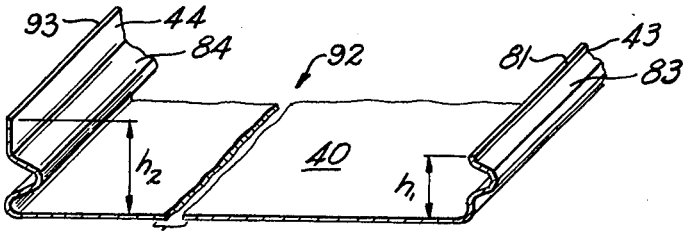
FIG. 29 is a fragmentary broken isometric view illustrating a futher alternative embodiment of a facing sheet.

FIG. 29 illustrates a facing sheet 92 wherein the first side wall 43 terminates in the first free edge 81 and the second side wall 44 terminates in a second free edge 93. In this embodiment, neither of the side walls is provided with a flange as in previously described embodiments.

Figure 30:
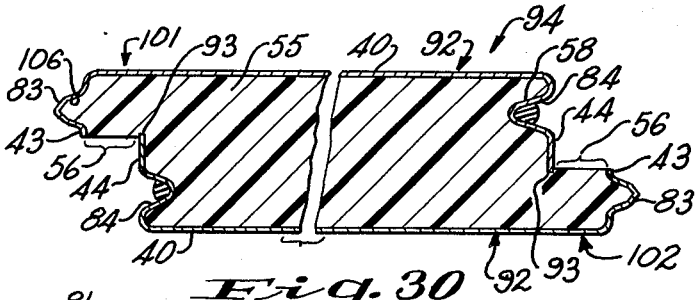
FIG. 30 is a broken cross-sectional view illustrating an alternative embodiment of the present building panel incorporating a pair of the facing sheets of FIG. 29.

A pair of the facing sheets 92 may be assembled in laterally offset relation to produce a building panel 94 (FIG. 30). In this embodiment, the second free edge 93 of the first side wall 44 of each facing sheet confronts the central web 40 of the other facing sheet and is laterally spaced-apart from the first side wall 43 of the other facing sheet, with the gap 56 therebetween. Both facing sheets are provided with complementary mating elements (ribs 83, 84).

Figure 31:
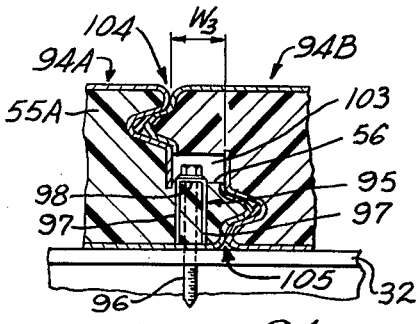
FIG. 31 is a fragmentary cross-sectional view, similar to FIG. 8, illustrating a connection between adjacent ones of the panel of FIG. 30.

As shown in FIG. 31, a pair of the building panels 94A, 94B may be erected in overlapped relation and secured to the subgirt 32 by means of a clip 95 and fastener 96. It will be observed in FIG. 31 that the clip 95 has a channel-shaped configuration including a pair of legs 97 connected by a web 98. The legs 97 penetrate the foam core 55 whereas the web 98 is essentially coplanar with the foam core in the region of the gap 56.

Figure 32:
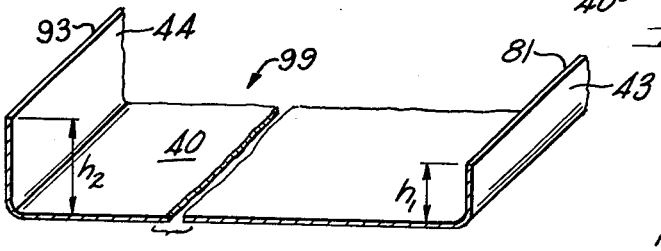
FIG. 32 is a fragmentary broken isometric view illustrating an alternaive embodiment of an inner facing sheet.
Figure 33:
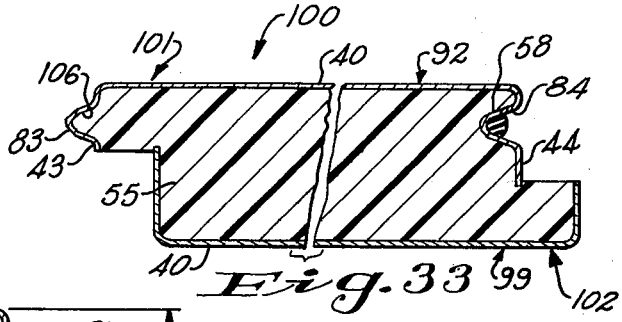
FIG. 33 is a broken cross-sectional view of an alternative embodiment of the present building panel incorporating the facing sheets of FIGS. 29 and 32.

FIG. 32 illustrates an inner facing sheet 99 wherein the first side wall 43 terminates in the first free edge 81 and the second side wall 44 terminates in the second free edge 93. The side walls 43, 44 are not provided with complementary mating elements. The inner facing sheet 99 may be assembled in laterally offset relation with the outer facing sheet 92 to produce a building panel 100 (FIG. 33). Adjacent ones of the building panels 100 may be assembled in overlapped relation and secured to a subgirt in exactly the same manner described above in connection with FIG. 31.

It will be observed in FIGS. 24, 27, 29 and 32 that in each of the facing sheets 80, 90, 92 and 99, the height $h_1$ of the first side wall 43 is less than the height $h_2$ of the second side wall 44. Because of the difference in height between the first and second side walls 43, 44, the resulting building panels 85, 91, 94 and 100 of FIGS. 25, 28, 30 and 33, respectively, present an overlapping edge portion 101 which is spaced outwardly from an overlapped edge portion 102 presented at the opposite side of the building panel. When, for example, a pair of the building panels 85A, 85B are assembled in edge overlapped relation as shown in FIG. 26, a space 103 is provided within which the arm 88 of the clip 86 and the head of the fastener 87 reside. A similar space 103 is provided in the arrangement illustrated in FIG. 31.

Positive mechanical connections are provided between the foam core 55 and the outer facing sheets of the panels 85, 91, 94 and 100 of FIGS. 25, 28, 30 and 33, respectively. At one side of the building panel, the arcuate side wall portion 58 which defines the complementary concave rib 84, projects laterally of the second side wall 44 into the foam core 55 thereby providing a positive mechanical connection between the facing sheet and the foam core 55. At the opposite side of the panel, the concave recess 106 provided by the convex rib 83, is completely filled by the foam core 55 thereby providing a second positive mechanical connection between the facing sheets and the foam core 55. As a result of this construction, each of the outer facing sheets 80, 92 of the panels 85, 91, 94 and 100, does not depend solely for its structural integrity upon the auto-adhesive bond between the foamed-in-place core and the outer facing sheet.

It will be observed in FIG. 9 that in the joint 107, the outboard seam 104 is separated from the inboard seam 105 by a distance indicated at $W_1$. That distance, $W_1$, also represents the amount of overlap between adjacent ones of the panels 61, for example. The facing sheets 80, 90 of FIGS. 24, 27, the first or re-entrant flange 45 (FIG. 9) has been eliminated from the first side wall 43. Consequently, a lesser amount of lateral offset is required when, for example, a pair of the facing sheets 80 are assembled to produce the building panel 85 (FIG. 25). A joint 108 (FIG. 26) is produced between the panels 85A, 85B, wherein the overlap $W_2$ is reduced — compare the overlaps $W_1$ (FIG. 9) and $W_2$ (FIG. 26).

In the facing sheets 92, 99 of FIGS. 29 and 32, the first or re-entrant flange 45 and the second flange 46 have been eliminated, respectively, from the first side wall 43 and the second side wall 44. Consequently, a lesser amount of lateral offset is required, for example, when a pair of the facing sheets 92 are assembled to produce the building panel 94 (FIG. 30). A joint 109 (FIG. 31) is produced between the panels 94A, 94B, wherein the overlap $W_3$ is reduced further — compare the overlaps $W_2$ (FIG. 26) and $W_3$ (FIG. 31).

In reducing the overlap from $W_1$ (FIG. 9) to $W_2$ (FIG. 26), the resulting joint 108 is approximately two and one half times stronger than the joint 107 of FIG. 9. In reducing the overlap from $W_2$ (FIG. 26) to $W_3$ (FIG. 31), the joint 109 is approximately two and three quarter times stronger than the joint 108 (FIG. 26) and approximately seven times stronger than the joint 107 (FIG. 9).

Figure 34:
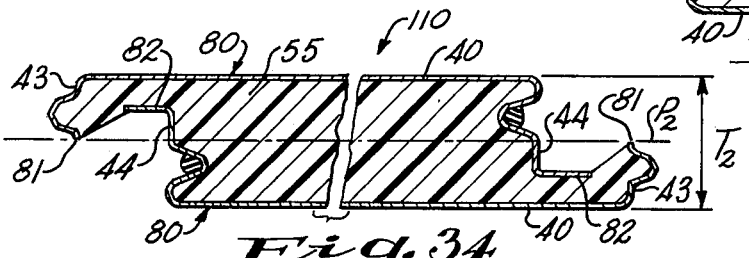
FIGS. 34 and 35 are broken cross-sectional views illustrating further alternative embodiments of the present building panel.
Figure 35:
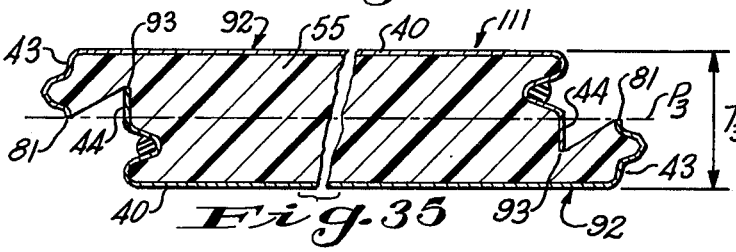

FIGS. 34 and 35 illustrate further alternative embodiments of the present building panel. Corresponding numerals will be employed to identify corresponding parts heretofore described.

FIG. 34 illustrates a building panel 110 comprising a pair of the facing sheets 80 and the foamed-in-place core 55. In this embodiment, the outward flange 82 of each facing sheet 80 is positioned at a level between (a) the confronting central web 40 of the other facing sheet 80; and (b) a plane $P_2$ which is generally parallel to the central web 40 and which intersects the second side walls 44 of both facing sheets 80. In the preferred embodiment, the plane $P_2$ also contains the first free edges 81 of the first side walls 43 of both facing sheets 80. The building panel 110 has a thickness indicated at $T_2$ which is less than, for example, the corresponding thickness of the building panel 85 illustrated in FIG. 25.

FIG. 35 illustrates a building panel 111 comprising a pair of the facing sheets 92 and the foamed-in-place core 55. In this embodiment, the second free edge 93 of the second side wall 44 of each facing sheet 92 is positioned at a level between (a) the confronting central web 40 of the other facing sheet 80; and (b) a plane $P_3$ which is generally parallel to the central web 40 which intersects the second side walls 44 of both facing sheets 92. In the preferred arrangement, the plane $P_3$ also contains the first free edges 81 of the first side walls 43 of both facing sheets 92. The building panel 111 has a thickness indicated at $T_3$ which is less than, for example, the corresponding thickness of the building panel 94 of FIG. 30. The arrangements illustrated in FIGS. 34, 35 have the advantage of utilizing a lesser quantity of core filling material.

Claims

1. A building construction panel comprising an outer facing sheet, an inner facing sheet and a foamed-in-place core disposed between the said outer facing sheet and the said inner facing sheet;

each of said facing sheet having a central web and a first side edge and a second side edge, a first side wall extending along the said first side edge, a second side wall extending along the said second side edge, a first flange re-entrant from the said first side wall generally parallel to the said central web, and a second flange extending outwardly from the said second side wall generally parallel to the said central web;

said outer facing sheet and said inner facing sheet being arranged with said second flange of each facing sheet confronting the opposing central web of the other facing sheet, and with the second flange of each facing sheet laterally sapced-apart from the said first flange of the other facing sheet whereby the said outer facing sheet is entirely spaced-apart from the said inner facing sheet; and complementary mating elements formed in said outer facing sheet, one disposed lengthwise of one said side wall and one disposed lengthwise of the other said side wall, said complementary mating elements being distinct and spaced from said first flange and said second flange of said outer facing sheet;

the said outer facing sheet including:

a channel-like configuration defined by the said first flange, the first side wall and an adjoining portion of the said central web;

said foamed-in-place core filling the channel-like configuration whereby a positive mechanical connection is provided between the said outer facing sheet and the said foamed-in-place core;

said panel adapted to be engaged side-by-side with others of said panel, with one of said mating elements of each panel engaged with the complementary mating element of an abutting panel whereby the outer facing sheets are mechanically engaged with one another.

2. The building construction panel defined in claim 1 wherein said complementary mating elements comprise:

a bead extending along the length of said one said side wall and a complementary groove extending along the said other said side wall.

3. The building construction panel defined in claim 2 wherein the said outer facing sheet includes:

an arcuate side wall portion projecting inwardly of said second side wall and defining the said complementary groove;

the said foamed-in-place core embracing said arcuate side wall portion to provide a positive mechanical connection between the said outer facing sheet and the said foamed-in-place core.

4. The building construction panel defined in claim 2 wherein the said first flange terminates at an edge spaced from the said first side wall.

5. The building construction panel defined in claim 2 wherein the said complementary mating elements provide the sole positive mechanical connection between the said outer facing sheet and the outer facing sheets of adjacent ones of said panel.

6. The building construction panel defined in claim 1 including complementary mating elements formed in said inner facing sheet, one disposed lengthwise along one said side wall and one disposed lengthwise along the other said side wall, said complementary mating elements being distinct from said first flange and said second flange of said inner facing sheet; and wherein said complementary mating elements of said inner facing sheet comprise:

a bead extending along the length of said one said side wall and a complementary groove extending along the said other said side wall.

7. The building construction panel defined in claim 1 including complementary mating elements formed in said inner facing sheet, one disposed lengthwise along one said side wall and one disposed lengthwise along the other said side wall, said complementary mating elements being distinct and spaced from said first flange and said second flange of said inner facing sheet; and wherein the said complementary mating elements of one said facing sheet comprise a bead extending along the length of one said side wall and a complementary groove extending along the other said side wall; and wherein the said complementary mating elements of the other said facing sheet comprise the said first side wall sloping away from the adjoining said first side edge and outwardly of the said central web, and the said second side wall sloping away from the adjoining said second side edge and inwardly over the said central web, the said first side wall and the said second side wall being generally parallel.

8. The building construction panel defined in claim 1 including complementary mating elements formed in said inner facing sheet, one disposed lengthwise along one said side wall and one disposed lengthwise along the other said side wall; and wherein the complementary mating elements in said outer facing sheet and the complementary mating elements in said inner facing sheet comprise:

a bead extending along the length of one said side wall and a complementary groove extending along the length of the other said side wall.

9. The building construction panel defined in claim 8 wherein the said first flange and the said second flange of the said inner facing sheet are positioned at a level between (a) the said central web of the said outer facing sheet and (b) a plane extending between the said first flange and the said second flange of the said outer facing sheet.

10. The building construction panel defined in claim 1 wherein one said facing sheet includes a lengthwise rib in the said second flange; and a complementary trough in the said first flange;

said panel adapted to be engaged side-by-side with others of said panel, with a said rib of each panel engaged with the complementary trough of the abutting panel.

11. The building construction panel defined in claim 10 including sealant material disposed along the juncture of said rib with said second side wall of said one facing sheet; and a lip at the juncture of said first flange and said first side wall of said one facing sheet;

said sealant material being positioned for engagement by a said lip of a said first side wall of an abutting panel, whereby an essentially weather-tight seal is provided.

12. The building construction panel defined in claim 1 wherein each said facing sheet includes a lengthwise rib in the said second flange; and a complementary lengthwise trough in the said first flange.

13. The building construction panel defined in claim 1 including:

preformed spacer members, one at each of a plurality of locations along the length of said panel, each of said spacer members having a first segment disposed between a said first flange and the said central web of one said facing sheet and a second segment disposed between a said second flange of the other facing sheet and a said central web of said one facing sheet.

14. A building construction panel comprising an outer facing sheet, an inner facing sheet and a foamed-in-place core disposed between the said outer facing sheet and the said inner facing sheet;

each said facing sheet having a central web and a first side edge and a second side edge, a first side wall extending along the said first side edge, a second side wall extending along the said second side edge, a first flange re-entrant from the said first side wall generally parallel to the said central web, and a second flange extending outwardly from the said second side wall generally parallel to the said central web;

the said outer facing sheet and the said inner facing sheet being laterally offset from one another such that the said second flange of each facing sheet (a) confronts the opposing central web of the other facing sheet and (b) is laterally spaced-apart from the said first flange of the other facing sheet;

the said first flange and the said second flange of the said inner facing sheet being positioned at a level between (c) the said central web of the said outer facing sheet and (d) a plane extending between the said first flange and the said second flange of the said outer facing sheet.

15. A building construction panel comprising an outer facing sheet, an inner facing sheet and a foamed-in-place core disposed between the said outer facing sheet and the said inner facing sheet;

each said facing sheet having a central web and a first side edge and a second side edge.

a first side wall extending along the said first side edge, a second side wall extending along the said second side edge, a first flange re-entrant from the said first side wall generally parallel to the said central web, and a second flange extending outwardly from the said second side wall generally parallel to the said central web;

said outer facing sheet and said inner facing sheet being arranged with said second flange of each facing sheet confronting the opposing central web of the other facing sheet, and with the said second flange of each facing sheet laterally spaced-apart from the said first flange of the other facing sheet whereby the said outer facing sheet is entirely spaced-apart from the said inner facing sheet; and complementary mating elements formed in said outer facing sheet, one disposed lengthwise of one said side wall and one disposed lengthwise of the other said side wall, said panel adapted to be engaged side-by-side with others of said panel, with one of said mating elements of each panel engaged with the complementary mating element of an abutting panel whereby the outer facing sheets are mechanically engaged with one another;

the said first flange and the said second flange of the said inner facing sheet being positioned at a level between (a) the said central web of the said outer facing sheet and (b) a plane extending between the said first flange and the said second flange of the said outer facing sheet.

16. A building construction panel comprising an outer facing sheet, an inner facing sheet and a foamed-in-place core disposed between said outer facing sheet and said inner facing sheet;

each said facing sheet having a central web presenting a first side edge and a second side edge, a first side wall extending along said first side edge and terminating in a first free edge remote from said central web, and a second side wall extending along said second side edge and terminating in a second free edge remote from said central web;

said outer facing sheet and said inner facing sheet being arranged with said second side wall of each facing sheet confronting the opposing central web of the other facing sheet, and with said second side wall of each facing sheet laterally spaced-apart from said first side wall of the other facing sheet whereby the said outer facing sheet is entirely spaced-apart from said inner facing sheet and said foam core presents (a) a first foam face extending between the adjacent first and second free edges of the outer and inner facing sheets respectively; and (b) a second foam face extending between the adjacent first and second free edges of the inner and outer facing sheets respectively; and complementary mating elements formed in said outer facing sheet, one disposed lengthwise of said first side wall adjacent to said first side edge and one disposed lengthwise of said second side wall adjacent to said second side edge but distinct and spaced-apart from said second free edge;

the distance between said first foam face and the central web of said inner facing sheet being greater than the distance between said second foam face and the central web of said inner facing sheet, whereby when said panel is engaged side-by-side with others of said panel said first foam face of each panel is outwardly spaced-apart from said second foam face of the adjacent panel thereby to provide a space for panel securing elements;

said panel adapted to be engaged side-by-side with others of said panel, with one of said mating elements of each panel engaged with the complementary mating element of an abutting panel whereby the outer facing sheets are mechanically engaged with one another.

17. The building construction panel defined in claim 16 wherein said second free edge of each facing sheet is positioned at a level between (a) the confronting central web of the other facing sheet and (b) a plane which is generally parallel to the central web and which intersects said second side wall of said outer facing sheet and said second side wall of said inner facing sheet.

18. The building construction panel defined in claim 17 wherein said plane contains said first free edge of said outer facing sheet and said first free edge of said inner facing sheet.

19. The building construction panel defined in claim 16 wherein said complementary mating elements comprises:

a convex rib extending along the length of one said side wall and a complementary concave rib extending along the other said side wall.

20. The building construction panel defined in claim 19 wherein said arcuate side wall portion is provided by said complementary concave rib;

said convex rib presenting a concave recess extending outwardly of said first side wall;

the said foamed-in-place core filling said concave recess to provide an additional positive mechanical connection between said outer facing sheet and said foamed-in-place core.

21. The building construction panel defined in claim 16 wherein said complementary mating elements provide the sole positive mechanical connection between said outer facing sheet and the outer facing sheet of adjacent ones of said panel.

22. The building construction panel defined in claim 16 including complementary mating elements formed in said inner facing sheet, one disposed lengthwise of said first side wall adjacent to said first side edge and one disposed lengthwise of said second side wall adjacent to said second side edge.

23. The building construction panel defined in claim 22 wherein said complementary mating elements of said inner facing sheet comprise:

a convex rib extending along the length of one said side wall and a complementary concave rib extending along the length of the other said side wall.

24. A building construction panel comprising an outer facing sheet, an inner facing sheet and a foamed-in-place core disposed between said outer facing sheet and said inner facing sheet;

each said outer facing sheet having a central web presenting a first side edge and a second side edge, a first side wall extending along said first side edge and terminating at a first free edge remote from said central web, a second side wall extending along said second side edge, a flange extending outwardly from said second side wall, generally parallel to said central web, and substantially entirely beyond said second side edge of said central web;

said outer facing sheet and said inner facing sheet being arranged with said flange of each facing sheet confronting the opposing central web of the other facing sheet, and with said flange of each facing sheet laterally spaced-apart from said first side wall of the other facing sheet whereby said outer facing sheet is entirely spaced-apart from said inner facing sheet; and complementary mating elements in said outer facing sheet, one disposed lengthwise of said first side wall adjacent to said first side edge, and one disposed lengthwise of said second side wall adjacent to said second side edge but distinct and spaced-apart from said flange;

the distance between the flange of said inner facing sheet and the central web of said inner facing sheet being greater than the distance between the flange of said outer facing sheet and the central web of said inner facing sheet, whereby when said panel is engaged side-by-side with others of said panel, the flange of each inner facing sheet is outwardly spaced-apart from the flange of each outer facing sheet thereby to provide a space therebetween for panel securing elements;

said panel being adapted to be engaged side-by-side with others of said panel, with one of said mating elements of each panel engaged with the complementary mating element of an abutting panel whereby the outer facing sheets are mechanically engaged with one another.

25. The building construction panel defined in claim 24 wherein said complementary mating elements comprise:

a convex rib extending along the length of one said side wall and a complementary concave rib extending along the length of the other said side wall.

26. The building construction panel defined in claim 25 wherein said outer facing sheet includes:

a concave recess extending outwardly of one said side wall and defining said convex rib; and an arcuate side wall portion projecting inwardly of the other said side wall and defining said complementary concave rib;

said foamed-in-place core filling said concave recess and embracing said arcuate side wall portion to provide positive mechanical connections between said outer facing sheet and said foamed-in-place core.

27. The building construction panel defined in claim 24 wherein said complementary mating elements provide the sole positive mechanical connection between said outer facing sheet and the outer facing sheets of adjacent ones of said panel.

28. The building construction panel defined in claim 24 including complementary mating elements formed in said inner facing sheet, one disposed lengthwise of said first side wall adjacent to said first side edge and one disposed lengthwise of said second side wall intermediate of said flange and said second side edge.

29. The building construction panel defined in claim 28 wherein said complementary mating elements of said inner facing sheet comprise:

a convex rib extending along the length of one said side walls and a complementary concave rib extending along the length of the other said side wall.

30. A building construction panel comprising an outer facing sheet, an inner facing sheet and a foamed-in-place core disposed between said outer facing sheet and said inner facing sheet;

each said outer facing sheet having a central web presenting a first side edge and a second side edge, a first side wall extending along said first side edge and terminating at a first free edge remote from said central web, a second side wall extending along said second side edge, a flange extending outwardly from said second side wall generally parallel to said central web;

said outer facing sheet and said inner facing sheet being arranged with said flange of each facing sheet confronting the opposing central web of the other facing sheet, and with said flange of each facing sheet laterally spaced-apart from said first side wall of the other facing sheet whereby said outer facing sheet is entirely spaced-apart from said inner facing sheet; and complementary mating elements in said outer facing sheet, one disposed lengthwise of said first side wall adjacent to said first side edge, and one disposed lengthwise of said second side wall adjacent to said second side edge but distinct and spaced-apart from said flange;

said flange of each facing sheet being positioned at a level between and spaced-apart from (a) the confronting central web of the other facing sheet, and (b) a plane which is generally parallel to the central web and which intersects said second side wall of said outer facing sheet and said second side wall of said inner facing sheet;

said panel adapted to be engaged side-by-side with others of said panel, with one of said mating elements of each panel engaged with the complementary mating element of an abutting panel whereby the outer facing sheets are mechanically engaged with one another.

31. The building construction panel defined in claim 30 wherein said plane contains the first free edge of the first side wall of said outer facing sheet and the first free edge of the first side wall of said inner facing sheet.

32. A building construction panel comprising an outer facing sheet, an inner facing sheet and a foamed-in-place core disposed between the outer facing sheet and the inner facing sheet;

each said facing sheet having a central web presenting a first side edge and a second side edge, a first side wall extending along said first side edge and terminating at a first free edge remote from said central web, a second side wall extending along said second side edge, and a flange extending outwardly from said second side wall, generally parallel to said central web;

said outer facing sheet and said inner facing sheet being laterally offset from one another such that said flange of each facing sheet (a) confronts the opposing central web of the other facing sheet and (b) is laterally spaced-apart from said first side wall of the other facing sheet;

said flange of each facing sheet being positioned at a level between (a) the confronting central web of the other facing sheet and (b) a plane which is generally parallel to the central web and which intersects said second side wall of said outer facing sheet and said second side wall of said inner facing sheet;

said flange of each facing sheet being spaced-apart from said plane, whereby said panel is adapted to be engaged side-by-side with others of said panel, with the flange of each inner facing sheet outwardly spaced-apart from the flange of each outer facing sheet thereby to provide a space therebetween for panel securing elements.

33. The building construction panel defined in claim 32 wherein said plane contains the first free edge of the first side wall of said outer facing sheet and the first free edge of the first side wall of said inner facing sheet.

* * * * *